US011414869B2

(12) United States Patent
Nash et al.

(10) Patent No.: US 11,414,869 B2
(45) Date of Patent: Aug. 16, 2022

(54) ROOFING SHINGLES, KITS THEREOF, ROOFING SYSTEMS INCLUDING THEM, AND METHODS FOR INSTALLING THEM

(71) Applicant: CertainTeed LLC, Malvern, PA (US)

(72) Inventors: Alex C. Nash, Downington, PA (US); Victoria McDonald, Malvern, PA (US)

(73) Assignee: CertainTeed LLC, Malvern, PA (US)

( * ) Notice: Subject to any disclaimer, the term of this patent is extended or adjusted under 35 U.S.C. 154(b) by 0 days.

(21) Appl. No.: 16/834,506

(22) Filed: Mar. 30, 2020

(65) Prior Publication Data

US 2020/0308835 A1 Oct. 1, 2020

Related U.S. Application Data

(60) Provisional application No. 62/826,661, filed on Mar. 29, 2019.

(51) Int. Cl.
*E04D 1/26* (2006.01)
*E04D 1/20* (2006.01)

(52) U.S. Cl.
CPC *E04D 1/26* (2013.01); *E04D 1/20* (2013.01)

(58) Field of Classification Search
CPC ..... E04D 1/26; E04D 1/20; E04D 2001/005
See application file for complete search history.

(56) References Cited

U.S. PATENT DOCUMENTS 1,326,899 A * 1/1920 Herbert ..... E04D 1/26 52/559
1,402,361 A * 1/1922 Gower ..... E04D 1/2918 52/532
1,732,403 A * 10/1929 Harris ..... E04D 1/26 52/555
1,776,949 A 9/1930 Lumbard
2,161,440 A 6/1939 Venrick
2,245,062 A 6/1941 Abraham
2,335,493 A 11/1943 Drinkall
2,863,405 A 12/1958 Leibrook et al.
2,935,416 A 5/1960 Dunbar et al.
3,247,631 A 4/1966 Lovness
(Continued)

FOREIGN PATENT DOCUMENTS

EP 1460197 A1 9/2004
RU 96310 U1 7/2010

*Primary Examiner* — Adriana Figueroa
(74) *Attorney, Agent, or Firm* — McDonnell Boehnen Hulbert & Berghoff LLP

(57) ABSTRACT

The present disclosure relates more particularly to kits and systems of roofing shingles that can provide a variety of shingle coverage thicknesses and patterns while simplifying design and installation. In one aspect, the disclosure provides a roofing system comprising a first array of overlapping first shingles disposed on a roof. The system includes a first number, n>=2, of overlapping horizontally-extending courses of linearly arranged first shingles, with horizontal and vertical offsets between courses. Each first shingle includes a top headlap portion extending from the first lateral edge to the second lateral edge and a bottom tab portion formed of a plurality of tabs extending from the headlap portion toward the bottom edge of the first shingle, the bottom tab portion having an open area that is at least 20% of the total area of the bottom tab portion.

18 Claims, 12 Drawing Sheets

(56) References Cited

U.S. PATENT DOCUMENTS 3,407,556 A 10/1968 Leibrook
3,624,975 A 12/1971 Morgan et al.
3,927,501 A 12/1975 Allen et al.
3,973,369 A * 8/1976 Smith ..... E04D 1/26 52/526
4,274,243 A 6/1981 Corbin et al.
4,422,266 A 12/1983 Slocum et al.
4,437,274 A 3/1984 Slocum et al.
4,468,903 A 9/1984 Eaton et al.
4,468,909 A 9/1984 Eaton
4,499,702 A * 2/1985 Turner ..... E04D 1/26 52/555
4,527,374 A * 7/1985 Corbin ..... E04D 1/26 52/557
D300,257 S 3/1989 Stahl
D309,027 S 7/1990 Noone et al.
D313,278 S 12/1990 Noone
D313,658 S 1/1991 Noone
5,181,361 A 1/1993 Hannah et al.
5,209,802 A 5/1993 Hannah et al.
D336,347 S 6/1993 Hannah et al.
5,232,530 A 8/1993 Malmquist et al.
D340,294 S 10/1993 Hannah et al.
D347,900 S 6/1994 Stapleton
5,369,929 A 12/1994 Weaver et al.
5,375,387 A * 12/1994 Davenport ..... E04D 1/26 52/557
5,397,460 A 3/1995 Koblanski
5,421,134 A 6/1995 Hannah et al.
5,426,902 A 6/1995 Stahl et al.
D366,124 S 1/1996 Hannah et al.
D369,421 S 4/1996 Kiik et al.
D375,563 S 11/1996 Hannah et al.
5,571,596 A 11/1996 Johnson
D376,660 S 12/1996 Hannah et al.
5,666,776 A 9/1997 Weaver et al.
5,822,943 A 10/1998 Frankoski et al.
D401,362 S 11/1998 Bondoc et al.
D401,363 S 11/1998 Bondoc et al.
5,860,263 A 1/1999 Sieling et al.
5,939,169 A 8/1999 Bondoc et al.
6,038,827 A 3/2000 Sieling
6,145,265 A 11/2000 Malarkey et al.
6,220,329 B1 4/2001 King et al.
6,361,851 B1 3/2002 Sieling et al.
6,457,290 B1 10/2002 Elliott
6,679,020 B2 * 1/2004 Becker ..... E04D 1/26 52/518
6,715,252 B2 4/2004 Stahl et al.
D504,962 S 5/2005 Sieling et al.
6,933,037 B2 8/2005 McCumber et al.
7,204,063 B2 4/2007 Kandalgaonkar
D552,267 S 10/2007 Kalkanoglu et al.
D554,275 S 10/2007 Sieling et al.
7,510,622 B2 3/2009 Kalkanoglu et al.
7,827,753 B2 11/2010 Nagarajan et al.
7,877,949 B1 2/2011 Elliott
8,240,100 B2 8/2012 Kalkanoglu et al.
8,256,185 B2 * 9/2012 Kirkey ..... E04D 1/26 52/748.1
D669,602 S 10/2012 Jenkins
D670,007 S 10/2012 Jenkins
8,438,812 B2 5/2013 King et al.
8,468,754 B2 6/2013 Railkar et al.
8,789,332 B1 7/2014 Halliley et al.
8,915,037 B2 * 12/2014 Jenkins ..... B32B 41/00 52/553
9,021,760 B2 5/2015 Kiik et al.
9,121,178 B2 9/2015 Belt et al.
9,140,012 B1 9/2015 Leitch et al.
9,212,487 B2 * 12/2015 Kiik ..... E04D 1/26
D750,810 S 3/2016 Buzza
9,279,255 B2 3/2016 Bryson et al.
9,290,944 B2 3/2016 Kalkanoglu et al.
D762,879 S 8/2016 Leitch
D762,880 S 8/2016 Leitch
D762,881 S 8/2016 Leitch
D763,470 S 8/2016 Leitch
D763,471 S 8/2016 Leitch
9,410,323 B1 * 8/2016 Leitch ..... E04D 1/20
9,752,324 B2 * 9/2017 Leitch ..... E04D 1/26
D799,721 S 10/2017 Leitch
9,808,947 B2 11/2017 Grubka et al.
D815,760 S 4/2018 Nash et al.
10,858,833 B2 12/2020 Jenkins et al.
2001/0022055 A1 * 9/2001 Zhang ..... E04D 1/20 52/309.1
2003/0172611 A1 * 9/2003 Coco ..... E04D 1/26 52/554
2004/0079042 A1 4/2004 Elliott
2004/0148874 A1 * 8/2004 Jolitz ..... E04D 1/205 52/105
2004/0148895 A1 * 8/2004 Jolitz ..... E04D 1/12 52/518
2004/0168761 A1 9/2004 Phillips
2004/0258883 A1 12/2004 Weaver
2005/0072109 A1 4/2005 Elliott
2005/0193673 A1 9/2005 Rodrigues et al.
2005/0204675 A1 9/2005 Snyder
2005/0252136 A1 * 11/2005 Hardin ..... E04D 1/26 52/518
2006/0101766 A1 * 5/2006 Jolitz ..... E04D 1/205 52/518
2006/0179767 A1 8/2006 Miller
2007/0251571 A1 11/2007 Jacobs
2008/0005995 A1 1/2008 Elliott
2008/0083187 A1 * 4/2008 Dennis ..... E04D 1/20 52/527
2009/0139175 A1 * 6/2009 Todd ..... E04D 1/26 52/557
2011/0041421 A1 * 2/2011 Jenkins ..... E04D 1/20 52/105
2011/0056148 A1 3/2011 Jenkins et al.
2011/0185668 A1 8/2011 Kiik et al.
2012/0174517 A1 7/2012 Jenkins
2013/0025768 A1 1/2013 Vermilion et al.
2014/0260047 A1 9/2014 Jenkins et al.
2014/0272244 A1 9/2014 Harrington, Jr. et al.
2015/0315789 A1 11/2015 Buzza
2015/0315790 A1 11/2015 Buzza
2015/0368904 A1 12/2015 Humphreys
2016/0017607 A1 1/2016 Kalkanoglu et al.
2016/0177569 A1 6/2016 Leitch
2019/0301160 A1 10/2019 Nash

* cited by examiner

ROOFING SHINGLES, KITS THEREOF, ROOFING SYSTEMS INCLUDING THEM, AND METHODS FOR INSTALLING THEM

CROSS-REFERENCE TO RELATED APPLICATIONS

This application claims the benefit of priority of U.S. Provisional Patent Application No. 62/826,661, filed Mar. 29, 2019, which is hereby incorporated herein by reference in its entirety.

BACKGROUND OF THE DISCLOSURE

1. Field of the Disclosure

The present disclosure relates generally to roofing shingles, kits thereof, roofing systems including them, and methods for installing them. The present disclosure relates more particularly to kits and systems that can provide a variety of shingle coverage thicknesses and patterns while simplifying design and installation.

2. Technical Background

The two most common types of bituminous (e.g., asphalt) roofing shingles are three-tab shingles and architectural or "laminated" shingles. Three-tab shingles are generally formed from a single bituminous sheet having a tab portion and a headlap portion, with three distinct "tabs" defined by two elongated notches between the tabs. The notches extend from a bottom edge of the shingle, through the tab portion toward the headlap portion. The shingles are laid in lateral rows on a roof in an edge-to-edge manner. To prevent the infiltration of water between the joints formed where the sides of two adjacent shingles meet, the tab portions of an upper row of shingles are typically installed so that they overlap the headlap portions of a lower row of shingles, in a repeating pattern where the joints are laterally staggered between rows.

Single-layer shingles are conventionally provided with three rectangular tabs, which, while effective at providing weather resistance to a roof, provide few opportunities for design flexibility. Multi-layer "architectural" shingles generally include a tab portion and a headlap portion. The tab portion of an architectural shingle is typically composed of a top bituminous sheet that includes tabs (e.g., so-called "dragon's teeth") that cover respective portions of a continuous bottom bituminous sheet. The headlap portion is typically composed solely or mostly of the top bituminous sheet. The top and bottom sheets are laminated together to present a layered appearance. Architectural shingles can provide design flexibility, but these are fixed by the manufacturer at the time of lamination.

Accordingly, what is needed is an improved roofing shingle system that provides design flexibility for shingle coverage and overall system appearance.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

The present inventors have noted disadvantages of conventional roofing shingle systems. In particular, conventional roofing shingle systems do not in many cases provide the desired degree of design flexibility with respect to roof coverage and appearance.

Figure 1:
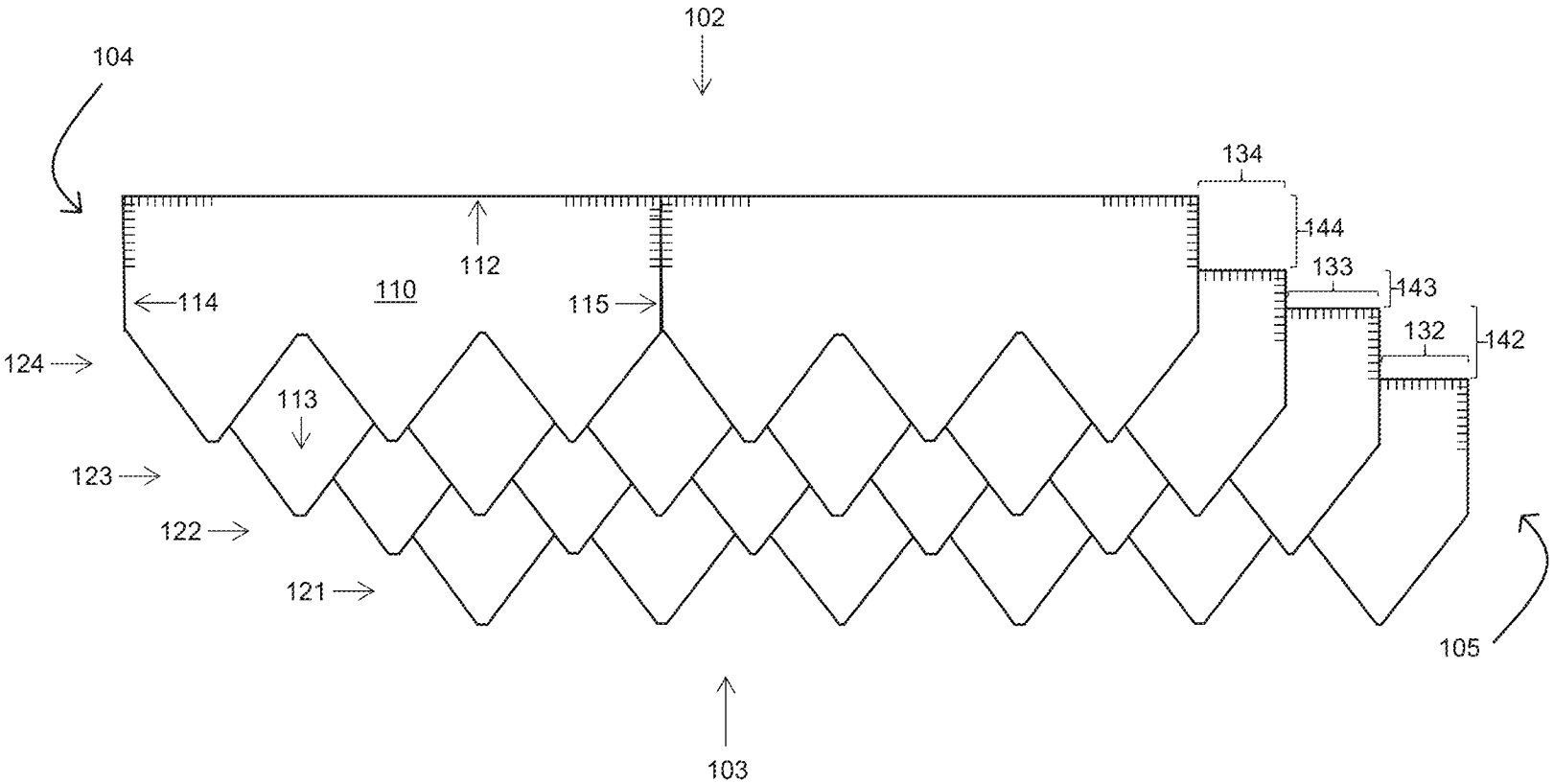
FIG. 1 is a schematic plan view of an array of shingles according to one embodiment of the disclosure.

Accordingly, one aspect of the disclosure is a roofing system that includes an array of overlapping first shingles disposed on a roof. Such an array is shown in schematic plan view in FIG. 1. Array 100 is formed from a plurality of overlapping first shingles 110 disposed on a pitched roof (not shown) and has a top edge 102 (i.e., disposed toward the ridge or other upper part of the roof), a bottom edge 103 (i.e., disposed toward the eave or other lower part of the roof), a first lateral edge 104 and a second lateral edge 105. Each first shingle has a top edge 112, a bottom edge 113, a first lateral edge 114 and a second lateral edge 115. The system includes a first number (n, which is at least two) of horizontally-extending courses of first shingles. In the embodiment of FIG. 1, there are four courses 121, 122, 123 and 124 (i.e., n=4). Only two first shingles are shown in each course in this example, but the person of ordinary skill in the art will appreciate that in many typical embodiments each course will include substantially more horizontally-arranged first shingles. Notably, first course 121 is disposed at the bottom edge of the array, and second course 122 is disposed closer to the top edge 102 of the array than the first course, and overlapping the first course, with a horizontal offset 132 and a vertical offset 142. This sequence continues through the horizontally-extending courses, as necessary, to provide a total of n courses, with an nth course disposed closer to the top edge of the array than the (n−1)th course, and overlapping the (n−1)th course, with a horizontal offset and a vertical offset with respect to the (n−1)th course. In the arrangement in FIG. 1, n is 4, so the sequence continues with third course 123 disposed closer to the top edge 102 of the array than the second course, and overlapping the second course, with a horizontal offset 133 and a vertical offset 143; and fourth course 124 disposed closer to the top edge 102 of the array than the third course, and overlapping the third course, with a horizontal offset 134 and a vertical offset 144. And in the arrangement of FIG. 7 (described in more detail below), n is 6, so the sequence includes a fifth course disposed closer to the top edge of the array than and overlapping the fourth course with a horizontal offset and a vertical offset with respect to the fourth course, and a sixth course disposed closer to the top edge of the array than and overlapping the fifth course with a horizontal offset and a vertical offset with respect to the fifth course.

Figure 2:
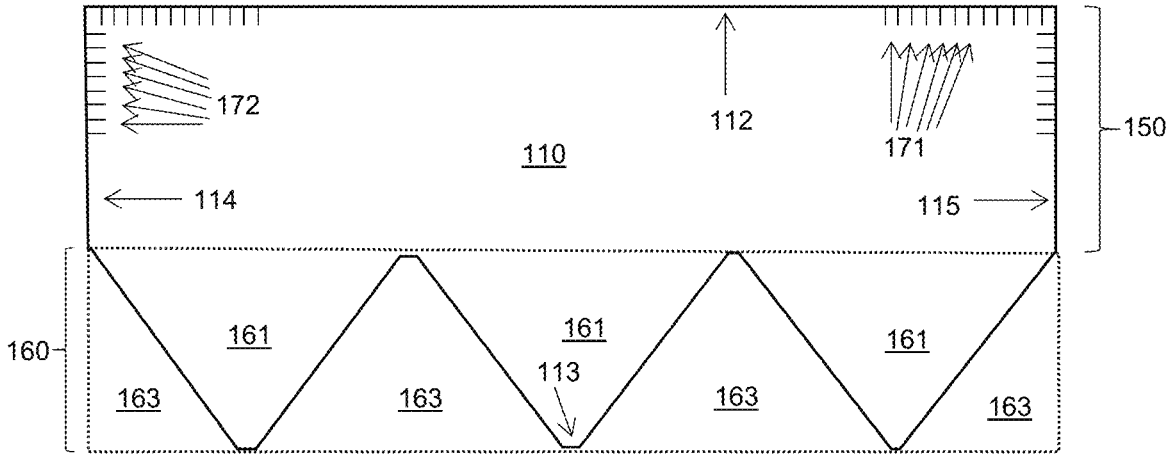
FIG. 2 is a schematic plan view of a shingle according to one embodiment of the disclosure.

A single first shingle 110 of array 100 is shown in schematic plan view in FIG. 2. First shingle 110 has a top headlap portion 150 extending from the first lateral edge 114 to the second lateral edge 115 of the first shingle. First shingle 110 also includes a bottom tab portion 160 formed of a plurality of tabs 161 extending from the top headlap portion 150 toward the bottom edge 113. Notably, the bottom edge of the shingle is determined by taking the overall envelope of the shingle as a parallelogram extending to the bottom edge of the tabs. In the example of FIG. 2, this is shown by a dotted line that forms an overall rectangle. But in other embodiments, the shingle can be formed with lateral edges at an angle to the top edge, and thus the overall envelope would be a non-right parallelogram. The dotted line defines total area of the tab portion.

Notably, the bottom tab portion has an open area, i.e., an area that is not an area of a tab, that is at least 20% of the total area of the bottom tab portion. In certain embodiments as otherwise described herein, the bottom tab portion has an open area that is at least 30% of the total area of the bottom tab portion. In certain such embodiments, the bottom tab portion has an open area that is at least 40% of the total area of the bottom tab portion, e.g., at least 45%. Advantageously, the present inventors have determined that use of a relatively large open area can provide a considerable area for underlying shingle tabs to show, thereby providing a high degree of design flexibility with respect to coverage of the roof deck by shingle material and with respect to overall appearance. However, too much open area can provide too little shingle material to waterproof and otherwise protect the roof deck. Accordingly, in certain embodiments as otherwise described herein, in each first shingle, the bottom tab portion has an open area that is no more than 70% of the total are of the bottom tab portion, e.g., no more than 60%, or no more than 50%. For example, in the embodiment of FIG. 2, the total area of the bottom tab portion is denoted by the dotted line; open area is denoted by reference numerals 163. In this example, the open area is roughly 50% of the bottom tab portion.

The tabs of the first shingles can take a variety of shapes to provide a desired degree of coverage (i.e., by providing a desired fraction of open area to the first shingle). For example, in certain embodiments as otherwise described herein and as shown in FIGS. 1 and 2, in a plurality of the first shingles (e.g., each of the first shingles as in FIG. 1), one or more of the tabs (e.g., each of the tabs as shown in FIGS. 1 and 2) is triangular. The person of ordinary skill in the art will appreciate that a "triangular" tab need not be perfectly geometrically triangular, but may have, e.g., a chamfer at the tip that is no more than 5% of the area of the triangle. For example, in certain embodiments (and as shown in FIGS. 1 and 2), each of a plurality of the first shingles (e.g., each of the first shingles) has a plurality of (e.g., at least two, or at least three, such as 2-8 or 3-8) triangular tabs forming a sawtooth pattern extending continuously from the first lateral edge to the second lateral edge thereof. Here, too, a small flat portion between the tabs (see FIG. 2) does not change the fact that the overall pattern is a "sawtooth." Here the pattern is such that two such first shingles placed next to one another form a continuous sawtooth pattern.

Figure 3:
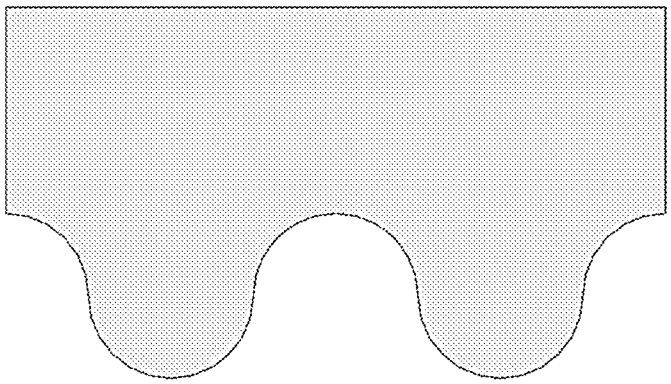
FIGS. 3, 4 and 5 are respective schematic plan views of various shingles according to other embodiments of the disclosure.

In certain embodiments as otherwise described herein, in a plurality of the first shingles (e.g., each of the first shingles), one or more of the tabs (e.g., each of the tabs) is rounded (e.g., semicircular, of an oval segment, of an elliptical segment, or otherwise curved). An example of such a first shingle is shown in schematic plan view in FIG. 3. The shingle of FIG. 3 includes two curved tabs. For example, in certain embodiments, and as shown in FIG. 3, each of a plurality of the first shingles (e.g., each of the first shingles) has a plurality of (e.g., at least two, or at least 3 such as 2-8 or 3-8) rounded tabs forming a wave pattern extending continuously from the first lateral edge to the second lateral edge thereof, such that two such first shingles placed next to one another form a continuous wave pattern.

Figure 4:
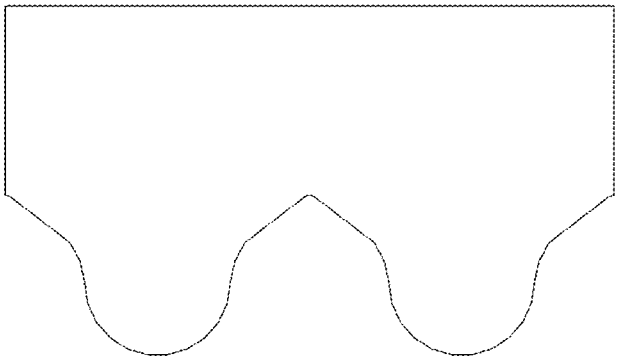
Figure 5:
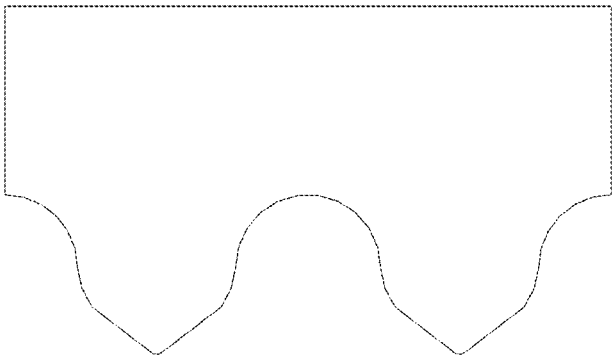

In certain embodiments as otherwise described herein, in a plurality of the first shingles (e.g., each of the first shingles), one or more of the tabs (e.g., each of the tabs) has a shape that includes both linear segments and curved segments. One such example is shown in schematic plan view in FIG. 4, and another is shown in schematic plan view in FIG. 5. For example, in certain embodiments, and as shown in FIG. 4, each of a plurality of the first shingles (e.g., each of the first shingles) has a plurality of (e.g., at least two, or at least three, such as 2-8 or 3-8) tabs each defined by opposing linear edges extending from the headlap portion and angled toward one another, and a curved segment joining the linear segments, the curved segment forming the bottom end of the tab. And in certain embodiments, and as shown in FIG. 5, each of a plurality of the first shingles (e.g., each of the first shingles) has a plurality of (e.g., at least two, or at least three, such as 2-8 or 3-8) tabs each defined by opposing curved edges extending from the headlap portion and angled toward one another, and opposing linear segments joining the curved edges, the linear segments forming the bottom end of the tab.

Of course, other shapes are possible and can be suitable in a variety of implementations. For example, in certain embodiments as otherwise described herein, in a plurality of the first shingles (e.g., each of the first shingles), one or more of the tabs (e.g., each of the tabs) has a shape that is polygonal. For example, in certain such embodiments, each of a plurality of the first shingles (e.g., each of the first shingles) has a plurality of (e.g., at least three, such as 3-8) tabs each in the shape of a trapezoid or a parallelogram.

An array as otherwise described herein can in certain embodiments include all of the same type of first shingle (e.g., all triangular tab first shingles, e.g., identical triangular tab first shingle). In other embodiments, an array as otherwise described herein can include a number of different types of first shingles (e.g., having different tab shapes). For example, in certain embodiments, an array as otherwise described herein can have each course having the same type of first shingle (e.g., having the same tab shapes, such as identical first shingles) within a course, but one or more courses including different types of first shingles (e.g., having different tab shapes). For example, in certain embodiments, one or more courses can be formed of first shingles having triangular tabs, and one or more courses can be formed of first shingles having curved tabs. Use of different types of shingles can provide a wider variety of shingle coverage patterns, especially in combination with the use of varying horizontal and/or vertical offset as described herein.

As noted above, each of the first shingles includes a plurality of tabs. In certain desirable embodiments, a plurality of the first shingles (e.g., each of the first shingles) includes at least three tabs. For example, in certain embodiments, a plurality of the first shingles (e.g., each of the first shingles) includes in the range of 3-8 tabs.

Figure 6:
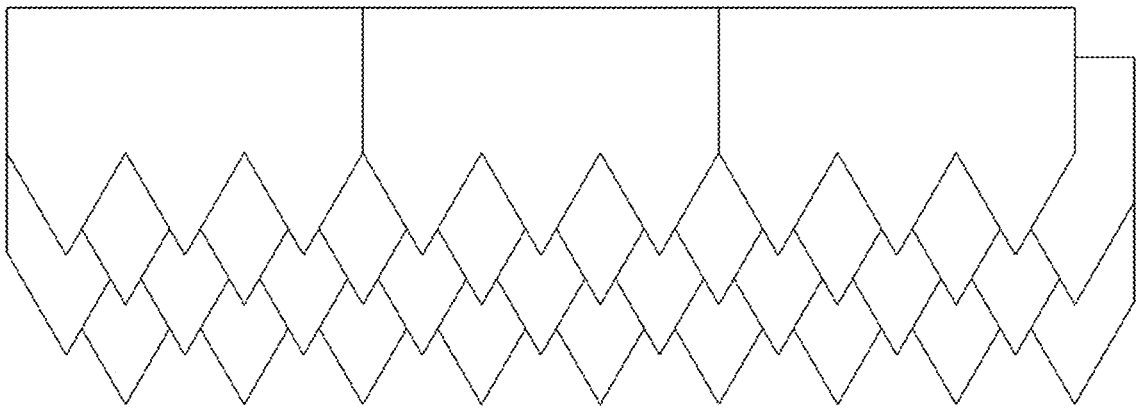
FIGS. 6 and 7 are respective schematic plan views of arrays of shingles according to other embodiments of the disclosure.
Figure 7:
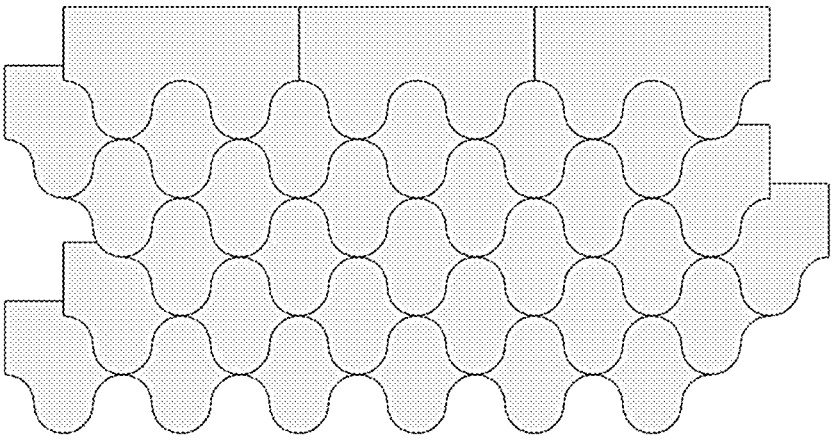

In certain embodiments as otherwise described herein, for a plurality of the first shingles (e.g., each of the first shingles), the tab portion of the first shingle is configured such that a plurality of such first shingles arranged horizontally form a continuous pattern of tabs (i.e., so that there is no discontinuity in the pattern between shingles). FIG. 6 is a schematic plan view of an array of triangular tab first shingles; here, the triangular tabs of the three first shingles in each course form a continuous sawtooth pattern. FIG. 7 is a schematic plan view of an array of rounded tab first shingles; here, the rounded tabs of the three first shingles of each course form a continuous wave pattern.

In certain desirable embodiments, in a plurality of (e.g., each of) the first shingles, the tabs are of the same width. In certain such embodiments as otherwise described herein (and as generally depicted in FIGS. 1-7), the sum of the widths of the tabs (i.e., at their widest point, e.g., from where they extend from the headlap portion) is within 10% of the width of the shingle, e.g., within 5% of the width of the shingle, or the same as the width of the shingle.

The tab portions of the first shingles are desirably comparable in height (i.e., in the top to bottom direction) with the headlap portions. For example, in certain desirable embodiments as otherwise described herein, in a plurality of the first shingles (e.g., each of the first shingles), the height of the lower tab portion is at least 50% of the height of the headlap portion. For example, in some embodiments, in a plurality of the first shingles (e.g., each of the first shingles), the height of the lower tab portion is at least 75% of the height of the headlap portion. And in some embodiments, in a plurality of the first shingles (e.g., each of the first shingles), the height of the lower tab portion is at least 95% of the height of the headlap portion.

Conventional three tab shingles are often installed such that the center of a tab of an overlying shingle is positioned over a notch of an underlying shingle, with a constant spacing between vertically overlapping courses. The present inventors have determined that the use of the first shingles as described herein can open a wide degree of design flexibility with respect to shingle coverage and visual pattern. This is especially true in that the first shingles described herein can be installed with a wide variety of vertical and horizontal offsets, and particularly different vertical and/or horizontal offsets as between courses, to provide a wide variety of patterns of shingle coverage. For example, in the embodiment of FIG. 1, the horizontal offset between the second and first course (132) is the same as the horizontal offset between the third and second course (133) and that between the fourth and third course (134). However, the vertical offset between the third and second course (143) is much less than that between the second course and the first course (142) and that between the fourth course and the third course (144). This results in a pattern of apparent diamond-shaped features of alternating size. And different patterns of vertical and horizontal offsets between courses can provide a wide selection of different patterns of shingle coverage.

To provide an installer with guidance as to providing multiple desired horizontal and/or vertical offsets in different courses of first shingles in the array, in certain embodiments the first shingles can include a plurality of horizontal overlap indicia and/or a plurality of vertical overlap indicia in the headlap portion thereof. These indicia can be configured to provide a guide for the alignment with respect to overlapping and/or underlapping courses of first shingles, to provide a desired. And as a plurality of such indicia are provided, the first shingles can conveniently be aligned with a variety of different horizontal and/or vertical overlaps. The indicia can take any form that visually informs a user of where an underlying or overlying first shingle is to be aligned, e.g., as a paint or ink mark, an embedded feature (e.g., into the bitumen of the shingle), or a depression, and can be in a variety of forms, e.g., selected from a line segment, an angular shape (e.g., triangles, diamonds) with a vertex forming each of the indicia, and an arrow.

In certain embodiments as otherwise described herein, each of a plurality of the first shingles (e.g., each of the first shingles) includes a plurality of horizontal overlap indicia in the headlap portion thereof, as shown in FIGS. 1 and 2. In the embodiment of FIG. 2, the plurality of horizontal overlap indicia 171 extend horizontally, here along the top edge of the shingle, to provide a guide for the installation of overlying shingles with a variety of overlaps.

In certain such embodiments, the horizontal overlap indicia in each such first shingle are evenly spaced from one another. In certain embodiments, the horizontal overlap indicia in each such first shingle are evenly spaced from one another and from a lateral edge of the first shingle. These configurations are shown in FIG. 2.

Desirably, a plurality of (e.g., each of) the first shingles includes at least three horizontal overlap indicia, e.g., at least four horizontal overlap indicia, or at least five horizontal overlap indicia. In certain embodiments, a plurality of (e.g., each of) the first shingles includes at least seven horizontal overlap indicia, e.g., at least 10 horizontal overlap indicia, or at least fifteen horizontal overlap indicia.

In certain desirable embodiments, a plurality of the horizontal overlap indicia are closely-spaced, to provide an installer with a closely-varying variety of horizontal offset values to use. For example, in certain embodiments, each first shingle having horizontal overlap indicia has a plurality of (e.g., at least three) horizontal overlap indicia are separated from one another by distances that are no more than three inches, e.g., no more than two inches. In certain embodiments, each first shingle having horizontal overlap indicia has a plurality of (e.g., at least three) horizontal overlap indicia are separated from one another by distances that are no more than one inch, e.g., no more than one-half inch. For example, in certain embodiments, each first shingle having horizontal overlap indicia has at least five (e.g., at least seven) horizontal overlap indicia are separated from one another by distances that are no more than three inches, e.g., no more than two inches. In certain embodiments, each first shingle having horizontal overlap indicia has at least five (e.g., at least seven) horizontal overlap indicia are separated from one another by distances that are no more than one inch, e.g., no more than one-half inch.

In certain embodiments, the horizontal overlap indicia are disposed proximate a lateral edge of the first shingle (e.g., with the nearest one within 4 inches, within 3 inches, within 2 inches or even within one inch of the lateral edge). In certain embodiments, the horizontal overlap indicia are disposed at a top edge of the first shingle.

In order to desirably provide a first shingle that can be installed with an offset in either direction as compared to the overlying course, it is desirable to include two sets of horizontal overlap indicia, including a first set proximate the first lateral edge of the (e.g., with the nearest one within 4 inches, within 3 inches, within 2 inches or even within one inch of the first lateral edge) and a second set disposed proximate the second lateral edge thereof (e.g., with the nearest one within 4 inches, within 3 inches, within 2 inches or even within one inch of the second lateral edge). Two sets of horizontal overlap indicia are shown in the embodiment of FIG. 2.

In a roofing system as otherwise described herein, for a plurality of such first shingles, e.g., each such first shingle, a first shingle of an overlapping course is arranged such that it is indexed to one of the overlap indicia. As the person of ordinary skill in the art will appreciate, such indexing can be performed in a number of ways. For example, in certain embodiments, for a plurality of the first shingles including horizontal overlap indicia (e.g., each such first shingle that is overlapped by another shingle) an overlapping shingle has a lateral edge in registration with one of the horizontal overlap indicia, as shown in the embodiment of FIG. 1.

Similar to the horizontal registration indicia, in certain embodiments as otherwise described herein, each of a plurality of the first shingles (e.g., each of the first shingles) includes a plurality of vertical overlap indicia in the headlap portion thereof. as shown in FIGS. 1 and 2. In the embodiment of FIG. 2, the plurality of overlap indicia 172 extend vertically, here along a lateral edge of the first shingle, to provide a guide for the installation of the first shingle with respect to an underlying shingle.

In certain such embodiments, the vertical overlap indicia in each such first shingle are evenly spaced from one another. In certain embodiments, the vertical overlap indicia in each such first shingle are evenly spaced from one another and from a top edge of the first shingle. These configurations are shown in FIG. 2.

Desirably, a plurality of (e.g., each of) the first shingles includes at least three vertical overlap indicia, e.g., at least four vertical overlap indicia, or at least five vertical overlap indicia. In certain embodiments, a plurality of (e.g., each of) the first shingles includes at least vertical horizontal overlap indicia, e.g., at least 10 vertical overlap indicia, or at least fifteen vertical overlap indicia.

In certain desirable embodiments, a plurality of the vertical overlap indicia are closely-spaced, to provide an installer with a closely-varying variety of vertical offset values to use. For example, in certain embodiments, each first shingle having vertical overlap indicia has a plurality of (e.g., at least three) vertical overlap indicia are separated from one another by distances that are no more than three inches, e.g., no more than two inches. In certain embodiments, each first shingle having vertical overlap indicia has a plurality of (e.g., at least three) vertical overlap indicia are separated from one another by distances that are no more than one inch, e.g., no more than one-half inch. For example, in certain embodiments, each first shingle having vertical overlap indicia has at least five (e.g., at least seven) vertical overlap indicia are separated from one another by distances that are no more than three inches, e.g., no more than two inches. In certain embodiments, each first shingle having vertical overlap indicia has at least five (e.g., at least seven) vertical overlap indicia are separated from one another by distances that are no more than one inch, e.g., no more than one-half inch.

In certain embodiments, the vertical overlap indicia are disposed proximate a top edge of the first shingle (e.g., with the nearest one within 4 inches, within 3 inches, within 2 inches or even within one inch of the top edge). In certain embodiments, the vertical overlap indicia are disposed at a lateral edge of the first shingle.

In order to desirably provide a first shingle that can be installed with an offset in either direction as compared to the overlying course, it is desirable to include two sets of vertical overlap indicia, including a first set proximate the first lateral edge of the first shingle (e.g., with the nearest one within 4 inches, within 3 inches, within 2 inches or even within one inch of the first lateral edge) and a second set disposed proximate the second lateral edge thereof (e.g., with the nearest one within 4 inches, within 3 inches, within 2 inches or even within one inch of the second lateral edge). Two sets of vertical overlap indicia are shown in the embodiment of FIG. 2.

In a roofing system as otherwise described herein, for a plurality of such first shingles, e.g., each such first shingle, the first shingle is arranged such that one of the vertical overlap indicia is indexed to a top edge of a shingle of an underlapping course, and/or a shingle of an overlapping course is arranged such that it is indexed (e.g., via an indexing mark) to one of the vertical overlap indicia.

As the person of ordinary skill in the art will appreciate, such indexing can be performed in a number of ways. For example, in certain embodiments, for a plurality of the first shingles including vertical overlap indicia (e.g., each such first shingle that overlaps an underlapped first shingle) the top edge of the underlapped first shingle is in registration with one of the vertical overlap indicia of the overlapping first shingle, as shown in the embodiment of FIG. 1.

Figure 8:
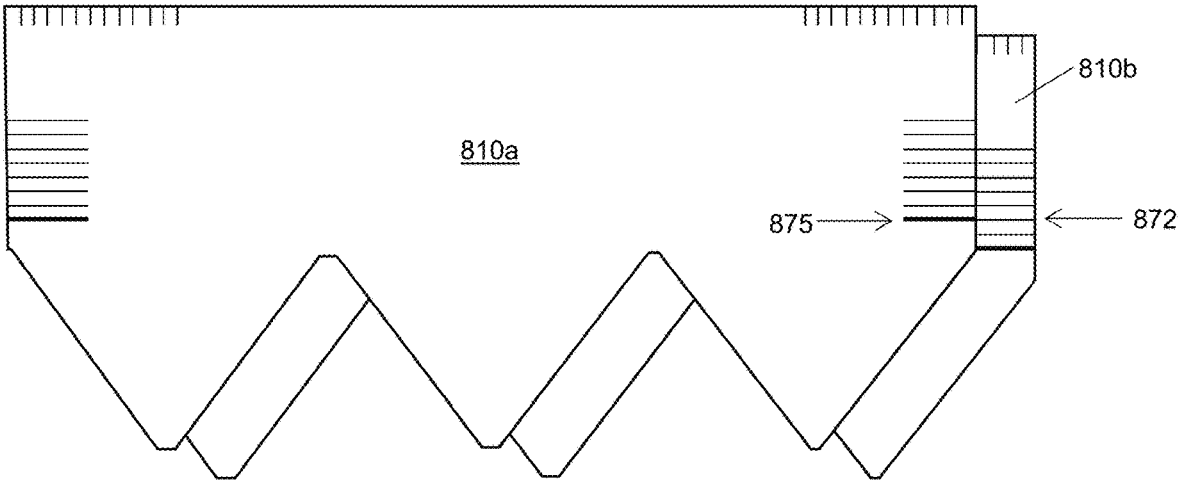
FIG. 8 is a schematic plan view of two shingles as arranged in an array according to another embodiment of the disclosure.

But other arrangements are possible. For example, in certain embodiments, a shingle of an overlapping course is arranged such that it is indexed (e.g., via a vertical registration marker on the shingle of the shingle of the overlapping course) to one of the vertical overlap indicia. This arrangement is shown in FIG. 8, in which first shingle 810*a* overlaps first shingle 810*b*. In each of these first shingles, the vertical overlap indicia are disposed closer to the tab portion, and extend farther into the body of the shingle than in the embodiments of FIGS. 1 and 2. Here, a vertical registration marker 875 is provided (in this embodiment shown as a darker line together with the vertical overlap indicia). The vertical registration marker 875 of the overlapping first shingle 810*a* is indexed to one of the vertical overlap indicia (872) of the underlapping first shingle 810*b*.

Vertical offsets can vary between courses, or can be the same. For example, in certain embodiments as otherwise described herein, n is at least three, and a first vertical offset between one of the courses and its respective underlying course is different between a second vertical offset between another of the courses and its respective underlying course. In certain such embodiments, of the total of (n−1) vertical offset values for each of the second through nth courses with respect to its respective underlying course, no more than 95% are the same, e.g., no more than 75%, or no more than 50%. In other embodiments, however, n is at least three, and of the total of (n−1) vertical offset values for each of the second through nth courses with respect to its respective underlying course, in excess of 90% are the same, e.g., in excess of 95%, or all of them are the same.

Similarly, horizontal offsets can vary between courses, or can be the same. For example, in certain embodiments as otherwise described herein, n is at least three, and a first horizontal offset between one of the courses and its respective underlying course is different between a second horizontal offset between another of the courses and its respective underlying course. In certain such embodiments, of the total of (n−1) horizontal offset values for each of the second through nth courses with respect to its respective underlying course, no more than 95% are the same, e.g., no more than S75%, or no more than 50%. However, in other embodiments, wherein n is at least three, wherein of the total of (n−1) horizontal offset values for each of the second through nth courses with respect to its respective underlying course, in excess of 90% are the same, e.g., in excess of 95%, or all of them are the same.

Figure 9:
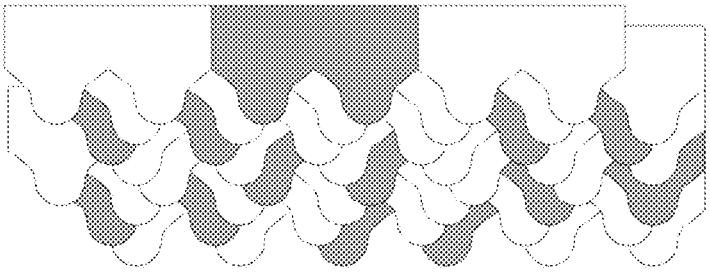
FIG. 9 is a schematic plan view of an array of shingles according to another embodiment of the disclosure.

Notably, in certain embodiments, different shingles of the array have different colors, in order to provide for an additional degree of design flexibility. For example, in the embodiment shown in schematic plan view in FIG. 9, the use of darker shingles can provide accents to the overall pattern. This is further exemplified by different shadings of shingles in many embodiments depicted herein.

Figure 10:
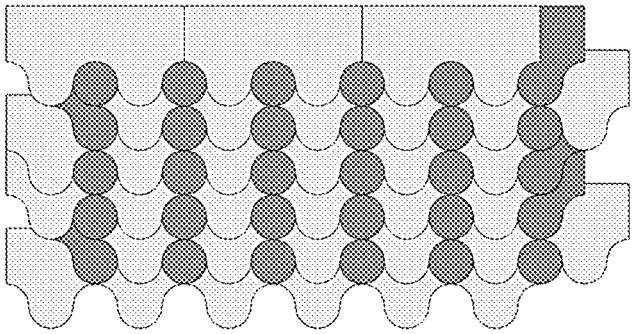
FIGS. 10 and 11 are respective schematic plan views of arrays of shingles according to other embodiments of the disclosure.
Figure 11:
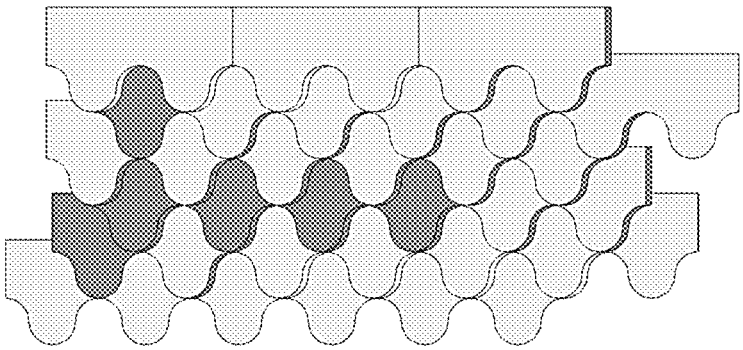
Figure 12:
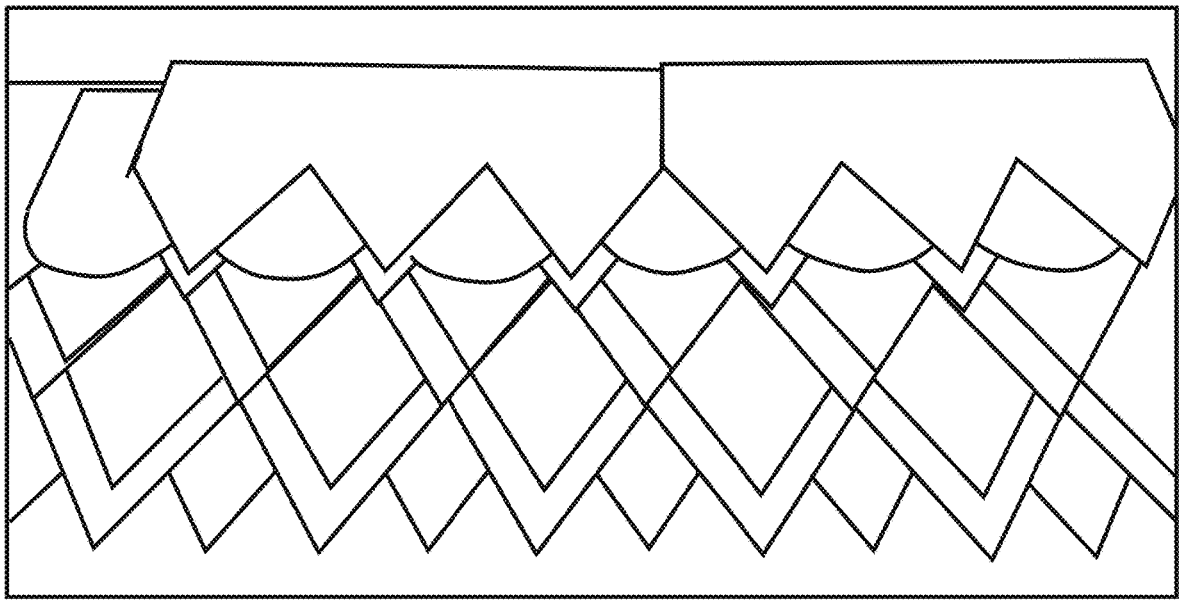
FIG. 12 is a drawing of an array of shingles according to another embodiment of the disclosure.
Figure 13:
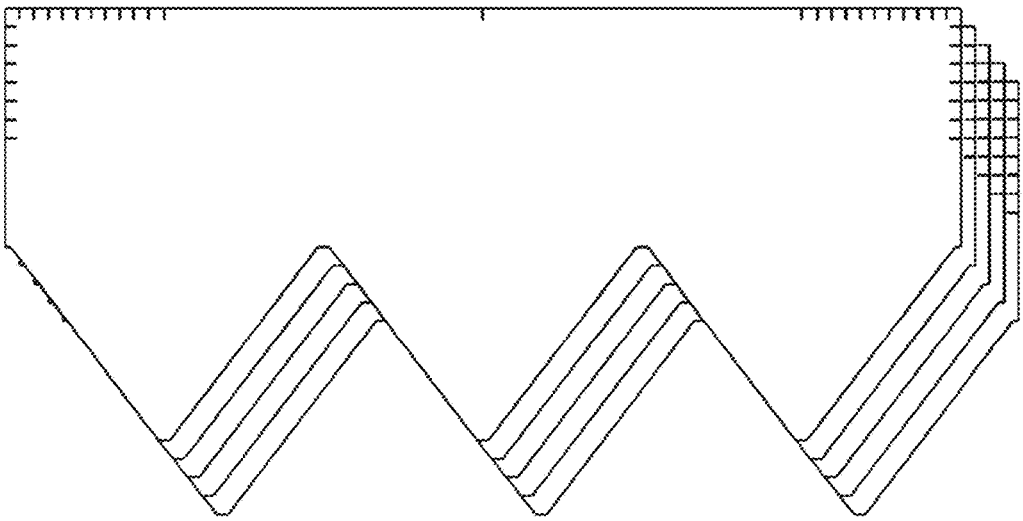
FIGS. 13-16 are a series of diagrams showing overlapping shingles with the same horizontal and vertical overlaps within each diagram.
Figure 14:
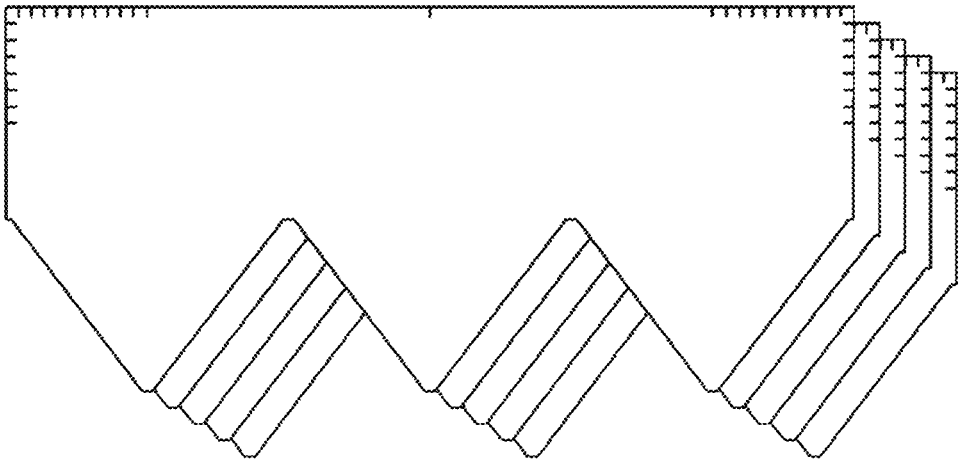
Figure 15:
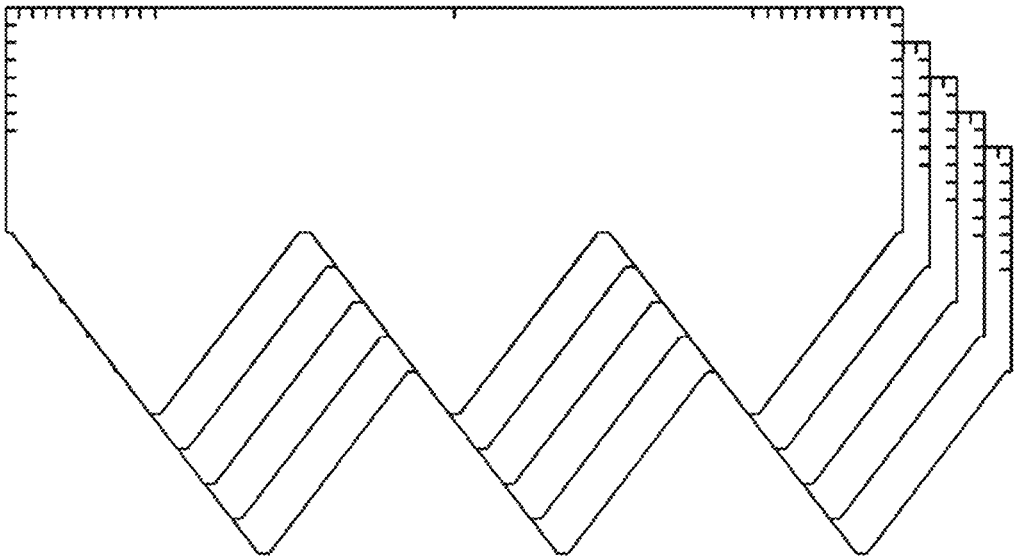
Figure 16:
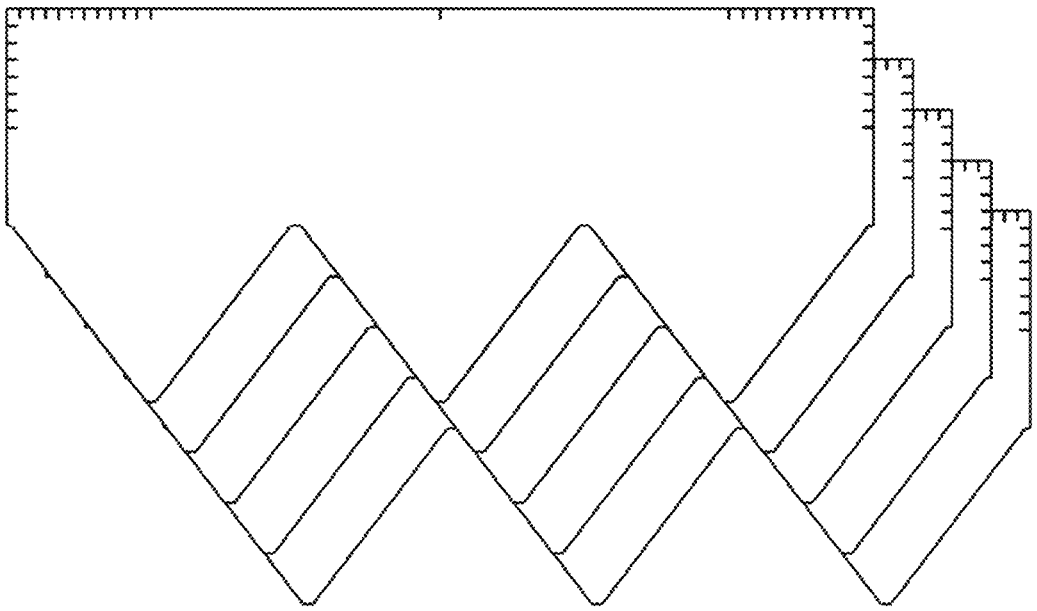

Use of different horizontal and/or vertical offsets between courses can provide a wide degree of flexibility in coverage and design. For example, in the embodiment of FIG. 1, the use of different vertical offsets provides a pattern of different apparent diamond shapes to the overlapping triangular tabs. In the example of FIG. 10, in some courses there is no vertical overlap between courses. In the Example of FIG. 11, in some courses there is no vertical or horizontal overlap between courses. In the Example of FIG. 12, use of different horizontal and vertical overlaps (especially when using a course with different tab shapes) can provide for a complex coverage pattern even when using only a couple of different types of shingles.

Even when consistent vertical and horizontal overlaps are used, the roofing systems and shingles described herein can provide a wide variety of different degrees of coverage and design, even from a single type of shingle. FIGS. 13-16 are a series of diagrams showing overlapping shingles with the same horizontal and vertical overlaps within each diagram, but differing overlaps between the diagrams.

Figure 17:
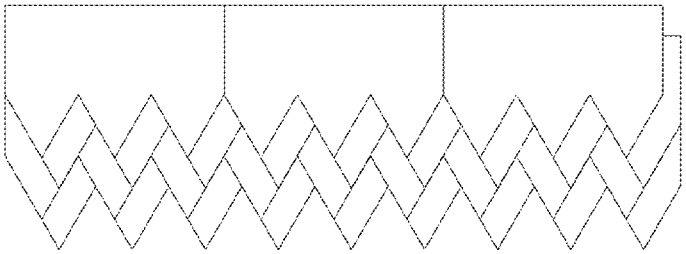
FIGS. 17-23 are respective schematic plan views of arrays of shingles according to other embodiments of the disclosure.
Figure 18:
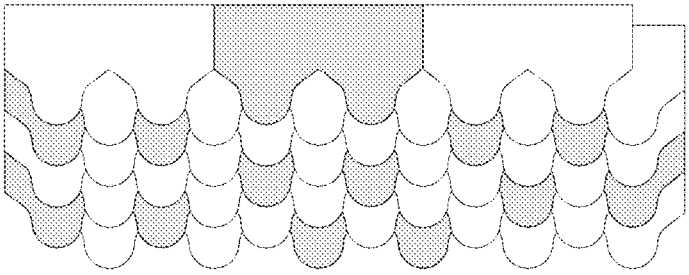
Figure 19:
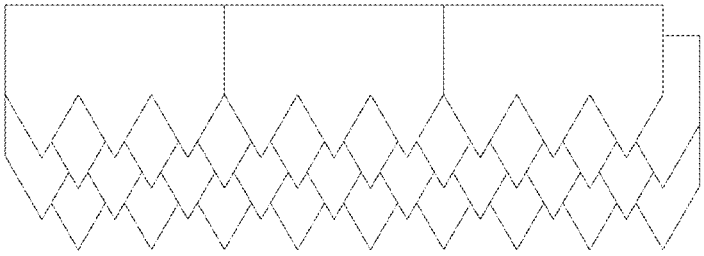
Figure 20:
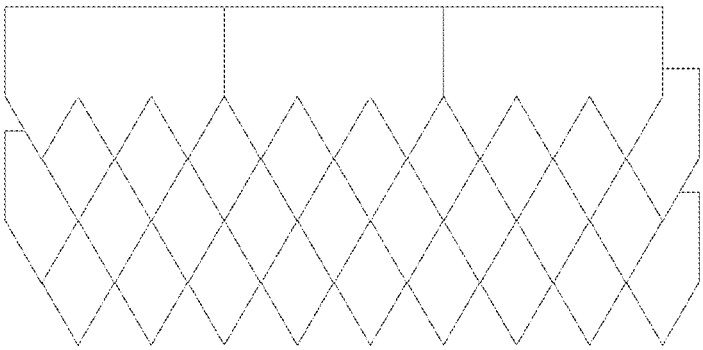
Figure 21:
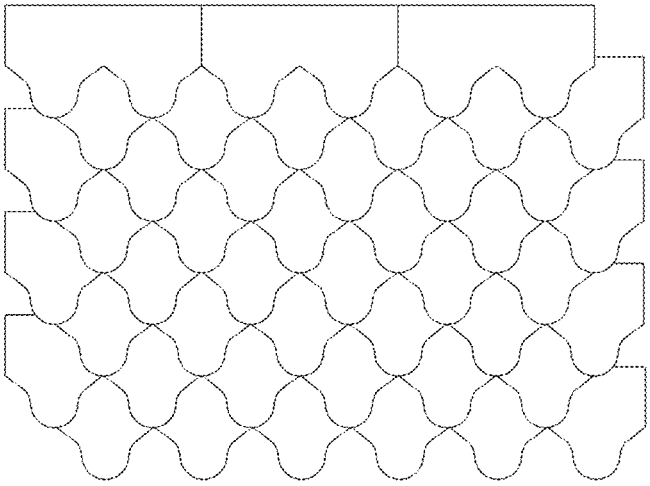
Figure 22:
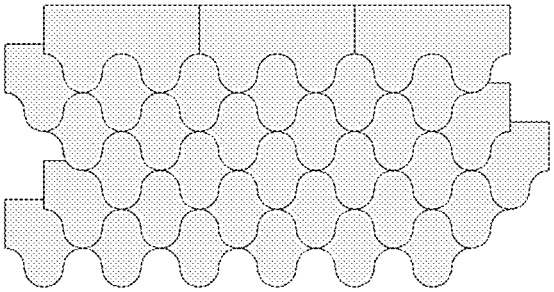
Figure 23:
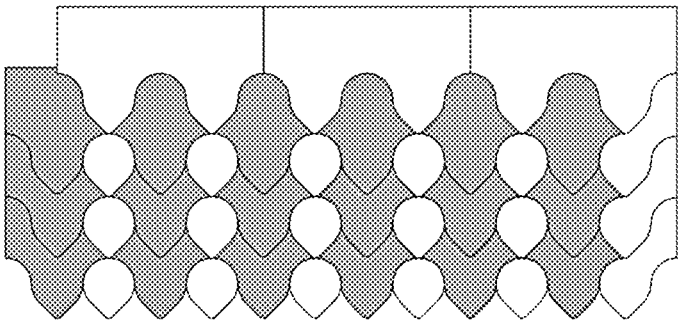

Shingles can in some embodiments be overlapped in a continually-offsetting arrangement (e.g., as in FIGS. 1 and 13-16). But in other embodiments, a so-called "racked" configuration can be used. For example, FIGS. 17 and 18 provide examples where constant horizontal and vertical offset distances are used, but in a racked configuration. This can be considered as having a "positive" horizontal offset between a first course and a second course, and a "negative" horizontal offset between the second course and the third course. This can provide a different overall design as compared to a configuration in which the horizontal offsets are all of the same sign; in this regard, FIG. 15 can be compared with FIG. 17.

A variety of additional configurations are shown in FIGS. 19-23.

Figure 24:
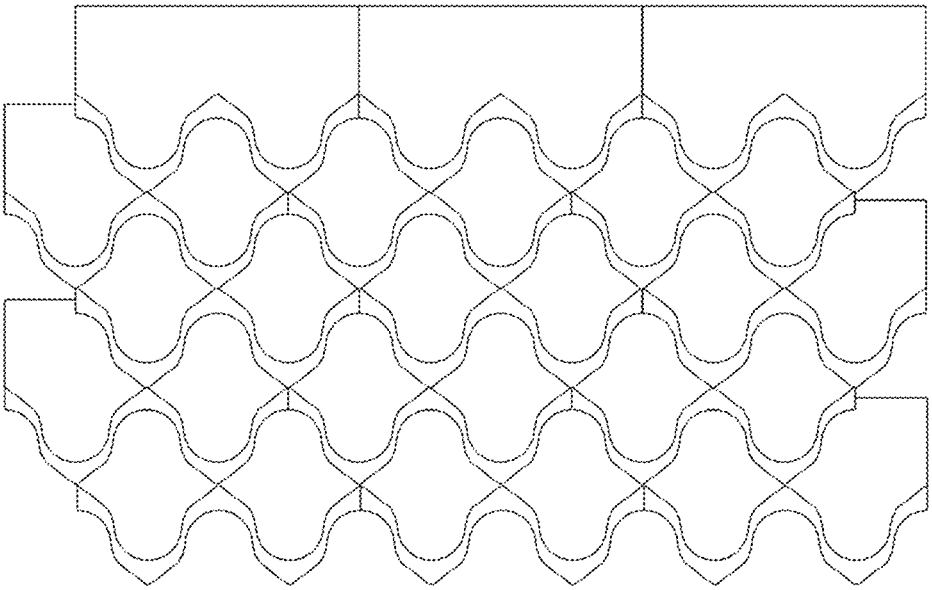
FIGS. 24 and 25 are respective plan views of arrays according to other embodiments of the disclosure, in which different shingle types are used in different courses.
Figure 25:
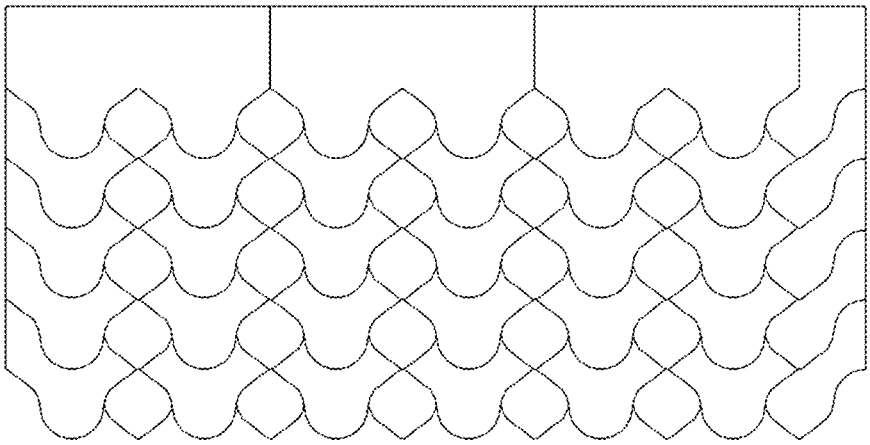

As demonstrated above, even the use of only one type of first shingle in the array (i.e., such that all first shingles are the same) can provide a high degree of flexibility in the provision of different patterns of coverage and design. But, notably, using different shingle types in different courses can further provide an even further a degree of flexibility. For example, in certain embodiments, at least one course includes first shingles that have a different tab configuration than the first shingles of another course. This can be, e.g., a different tab size, or even a different tab shape altogether. For example, in the embodiment of FIG. 12, rounded tab shingles are used in the seventh course from the bottom, with triangular tab shingles used in all other courses. The embodiments of FIGS. 24 and 25 also use different shingle types in different shingle courses.

The person of ordinary skill in the art can use a number of shingles horizontally arranged in each course to provide the desired area of coverage on the roof. For example, in certain embodiments, each of the first number (n) of courses includes at least three first shingles, e.g., at least four first shingles, or at least five first shingles or at least six first shingles. In certain embodiments, each of the first shingles in a course is the same.

The arrays described herein need not cover an entire roof or roof section. Rather, in some embodiments, the arrays described herein can be provided together with other roofing shingles arrayed conventionally. For example, an array of roofing shingles as described herein can be used, e.g., as two, three, four or five courses, with other roofing shingles overlapped at the top and or bottom edge of the array, in order to provide a section with a desired overlap pattern (e.g., as a linear-appearing feature or an area of increased coverage on the roof).

Another aspect of the disclosure is a kit comprising a plurality of first shingles as described in any embodiment herein. In certain embodiments, the kit includes at least 12 such first shingles, e.g., at least 20 such first shingles. The first shingles can be packaged together, e.g., in a bundle. In certain embodiments, the first shingles of the kit are the same as one another. In other embodiments, there are at least two different types of first shingles (e.g., of different tab shape) in the kit.

Use of the systems, shingles, kits and methods described herein can provide a variety of advantages. For example, systems can be provided that have a varying degree of coverage of shingle material at different parts of the roof, such that additional protective effect can be provided where needed. For example, during winter ice damming can be a significant issue on the roof near the eaves of a house. The systems described herein can be provided with more overlapping layers of shingle material at the eave, and thus provide additional protection. The systems, shingles, its and methods described herein can also provide a variety of design options available, even from a single shingle type.

Conventional granule-coated roofing shingle constructions can be used in the systems, shingles, kits and methods described herein. In certain desirable embodiments, the shingles are single-layer bituminous shingles. The present inventors have determined that, through the systems, shingles, kits and methods described herein, even single-layer shingles can provide a wide degree of flexibility in providing different coverages and designs to the system. Conventional methodologies for shingle construction can be used in the manufacturing of the roofing shingles as described herein. Conventional methods for installation of roofing shingles can be used to install the systems described herein, e.g., by installing the courses of shingles in an overlapping fashion, working from the bottom edge of the array to the top edge of the array. Offset indicia as described herein can be used to help align shingles of overlapping courses with respect to one another, although in other embodiments conventional methods can be used to align shingles without offset indicia to one another, e.g., by snapping chalk lines for use in alignment.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

Additional aspects of the disclosure are provided by the following enumerated embodiments, which can be combined or permuted in any number and in any combination that is not technically or logically inconsistent.

Embodiment 1

A roofing system comprising a first array of overlapping first shingles disposed on a roof, the first array having a top edge, a bottom edge, a first lateral edge and a second lateral edge, each first shingle having a top edge, a bottom edge, a first lateral edge and a second lateral edge, the system comprising a first number, n, of horizontally-extending courses, each course comprising a plurality of linearly arranged first shingles, where n is at least two, with a first course being disposed at the bottom edge of the array, a second course disposed closer to the top edge of the array than and overlapping the first course with a horizontal offset and a vertical offset with respect to the first course, with the sequence continuing, as necessary, to provide a total of n courses, with an nth course disposed closer to the top edge of the array than and overlapping an (n−1)th course with a horizontal offset and a vertical offset with respect to the nth course;

each first shingle comprising a top headlap portion extending from the first lateral edge to the second lateral edge and a bottom tab portion formed of a plurality of tabs extending from the headlap portion toward the bottom edge of the first shingle, the bottom tab portion having an open area that is at least 20% of the total area of the bottom tab portion.

Embodiment 2

A roofing system according to embodiment 1, wherein each of the first shingles is a single-layer shingle.

Embodiment 3

A roofing system according to embodiment 1 or embodiment 2, wherein in each first shingle, the bottom tab portion has an open area that is at least 30% of the total area of the bottom tab portion.

Embodiment 4

A roofing system according to embodiment 1 or embodiment 2, wherein in each first shingle, the bottom tab portion has an open area that is at least 40% (e.g., at least 45%) of the total area of the bottom tab portion.

Embodiment 5

A roofing system according to any of embodiments 1-4 wherein in each first shingle, the bottom tab portion has an open area that is no more than 70% of the total area of the bottom tab portion.

Embodiment 6

A roofing system according to any of embodiments 1-4 wherein in each first shingle, the bottom tab portion has an open area that is no more than 60% of the total area of the bottom tab portion.

Embodiment 7

A roofing system according to any of embodiments 1-4 wherein in each first shingle, the bottom tab portion has an open area that is no more than 50% of the total area of the bottom tab portion.

Embodiment 8

A roofing system according to any of embodiments 1-7, wherein in a plurality of the first shingles (e.g., each of the first shingles), one or more of the tabs (e.g., each of the tabs) is triangular.

Embodiment 9

A roofing system according to embodiment 8, wherein each of a plurality of the first shingles (e.g., each of the first shingles) has a plurality of (e.g., at least two, or at least three, such as 2-8 or 3-8) triangular tabs forming a sawtooth pattern extending continuously from the first lateral edge to the second lateral edge thereof, such that two such first shingles placed next to one another form a continuous sawtooth pattern.

Embodiment 10

A roofing system according to any of embodiments 1-9, wherein in a plurality of the first shingles (e.g., each of the first shingles), one or more of the tabs (e.g., each of the tabs) is rounded (e.g., semicircular, of an oval segment, of an elliptical segment, or otherwise curved).

Embodiment 11

A roofing system according to embodiment 10, wherein each of a plurality of the first shingles (e.g., each of the first shingles) has a plurality of (e.g., at least two, or at least 3 such as 2-8 or 3-8) rounded tabs forming a wave pattern extending continuously from the first lateral edge to the second lateral edge thereof, such that two such first shingles placed next to one another form a continuous wave pattern.

Embodiment 12

A roofing system according to any of embodiments 1-11, wherein in a plurality of the first shingles (e.g., each of the first shingles), one or more of the tabs (e.g., each of the tabs) has a shape that includes both linear segments and curved segments.

Embodiment 13

A roofing system according to embodiment 12, wherein each of a plurality of the first shingles (e.g., each of the first shingles) has a plurality of (e.g., at least two, or at least three, such as 2-8 or 3-8) tabs each defined by opposing linear edges extending from the headlap portion and angled toward one another, and a curved segment joining the linear segments, the curved segment forming the bottom end of the tab.

Embodiment 14

A roofing system according to embodiment 12 or embodiment 13, wherein each of a plurality of the first shingles (e.g., each of the first shingles) has a plurality of (e.g., at least two, or at least three, such as 2-8 or 3-8) tabs each defined by opposing curved edges extending from the headlap portion and angled toward one another, and opposing linear segments joining the curved edges, the linear segments forming the bottom end of the tab.

Embodiment 15

A roofing system according to any of embodiments 1-14, wherein in a plurality of the first shingles (e.g., each of the first shingles), one or more of the tabs (e.g., each of the tabs) has a shape that is polygonal.

Embodiment 16

A roofing system according to embodiment 15, wherein each of a plurality of the first shingles (e.g., each of the first shingles) has a plurality of (e.g., at least three, such as 3-8) tabs each in the shape of a trapezoid or a parallelogram.

Embodiment 17

A roofing system according to any of embodiments 1-16, wherein a plurality of the first shingles (e.g., each of the first shingles) includes at least three tabs, e.g., in the range of 3-8 tabs.

Embodiment 18

A roofing system according to any of embodiments 1-17, wherein for a plurality of the first shingles (e.g., each of the first shingles), the tab portion of the first shingle is configured such that a plurality of such first shingles arranged horizontally form a continuous pattern of tabs.

Embodiment 19

A roofing system according to any of embodiments 1-18, wherein in a plurality of (e.g., each of) the first shingles, the tabs are of the same width.

Embodiment 20

A roofing system according to embodiment 19, wherein the sum of the widths of the tabs (i.e., at their widest point, e.g., from where they extend from the headlap portion) is within 10% of the width of the shingle, e.g., within 5% of the width of the shingle, or the same as the width of the shingle.

Embodiment 21

A roofing system according to any of embodiments 1-20, wherein in a plurality of the first shingles (e.g., each of the first shingles), the height of the lower tab portion is at least 50% of the height of the headlap portion.

Embodiment 22

A roofing system according to any of embodiments 1-20, wherein in a plurality of the first shingles (e.g., each of the first shingles), the height of the lower tab portion is at least 75% of the height of the headlap portion.

Embodiment 23

A roofing system according to any of embodiments 1-20, wherein in a plurality of the first shingles (e.g., each of the first shingles), the height of the lower tab portion is at least 95% of the height of the headlap portion.

Embodiment 24

A roofing system according to any of embodiments 1-23, wherein each of a plurality of the first shingles (e.g., each of the first shingles) includes a plurality of horizontal overlap indicia in the headlap portion thereof, the plurality of horizontal overlap indicia extending horizontally, wherein a shingle of an overlapping course is arranged such that it is indexed to one of the overlap indicia.

Embodiment 25

A roofing system according to embodiment 24, wherein the horizontal overlap indicia in each such first shingle are evenly spaced from one another.

Embodiment 26

A roofing system according to embodiment 24, wherein the horizontal overlap indicia in each such first shingle are evenly spaced from one another and from a lateral edge of the first shingle.

Embodiment 27

A roofing system according to any of embodiments 24-26, wherein each such first shingle includes at least three horizontal overlap indicia, e.g., at least four horizontal overlap indicia, or at least five horizontal overlap indicia.

Embodiment 28

A roofing system according to any of embodiments 24-26, wherein each such first shingle includes at least seven horizontal overlap indicia, e.g., at least ten horizontal overlap indicia, or at least fifteen horizontal overlap indicia.

Embodiment 29

A roofing system according to any of embodiments 24-28, wherein in each such first shingle a plurality of (e.g., at least three) horizontal overlap indicia are separated from one another by distances that are no more than three inches, e.g., no more than two inches.

Embodiment 30

A roofing system according to any of embodiments 24-28, wherein in each such first shingle a plurality of (e.g., at least three) horizontal overlap indicia are separated from one another by distances that are no more than one inch, e.g., no more than one-half inch.

Embodiment 31

A roofing system according to any of embodiments 24-28, wherein in each such first shingle at least five (e.g., at least seven) horizontal overlap indicia are separated from one another by distances that are no more than three inches, e.g., no more than two inches.

Embodiment 32

A roofing system according to any of embodiments 24-28, wherein in each such first shingle at least five (e.g., at least seven) horizontal overlap indicia are separated from one another by distances that are no more than one inch, e.g., no more than one-half inch.

Embodiment 33

A roofing system according to any of embodiments 24-32, wherein the horizontal overlap indicia are disposed proximate a lateral edge of the first shingle (e.g., with the nearest one within 4 inches, within 3 inches, within 2 inches or even within one inch of the lateral edge).

Embodiment 34

A roofing system according to any of embodiments 24-33, wherein the horizontal overlap indicia are disposed at a top edge of the first shingle.

Embodiment 35

A roofing system according to any of embodiments 24-34, wherein two sets of horizontal overlap indicia are present, including a first set disposed proximate the first lateral edge thereof (e.g., with the nearest one within 4 inches, within 3 inches, within 2 inches or even within one inch of the first lateral edge) and a second set disposed proximate the second lateral edge thereof (e.g., with the nearest one within 4 inches, within 3 inches, within 2 inches or even within one inch of the second lateral edge).

Embodiment 36

A roofing system according to any of embodiments 24-35, wherein for a plurality of the first shingles including horizontal overlap indicia (e.g., each such first shingle that is overlapped by another shingle) an overlapping shingle has a lateral edge in registration with one of the horizontal overlap indicia.

Embodiment 37

A roofing system according to any of embodiments 24-36, wherein each of the horizontal overlap indicia is in the form of a line segment, an angular shape (e.g., triangles, diamonds) with a vertex forming each of the indicia, and an arrow.

Embodiment 38

A roofing system according to any of embodiments 1-37, wherein each of a plurality of the first shingles (e.g., each of the first shingles) includes a plurality of vertical overlap indicia in the headlap portion thereof, the plurality of vertical overlap indicia extending vertically, wherein the first shingle is arranged such that one of the vertical overlap indicia is indexed to a top edge of a shingle of an underlapping course; and/or a shingle of an overlapping course is arranged such that it is indexed (e.g., via a vertical registration marker on the shingle of the overlapping course) to one of the vertical overlap indicia of the first shingle.

Embodiment 39

A roofing system according to embodiment 38, wherein the vertical overlap indicia in each such first shingle are evenly spaced from one another.

Embodiment 40

A roofing system according to embodiment 38, wherein the vertical overlap indicia in each such first shingle are evenly spaced from one another and from a top edge of the first shingle.

Embodiment 41

A roofing system according to any of embodiments 38-40, wherein each such first shingle includes at least three vertical overlap indicia, e.g., at least four vertical overlap indicia, or at least five vertical overlap indicia.

Embodiment 42

A roofing system according to any of embodiments 38-40, wherein each such first shingle includes at least seven vertical overlap indicia, e.g., at least ten vertical overlap indicia, or at least fifteen vertical overlap indicia.

Embodiment 43

A roofing system according to any of embodiments 38-42, wherein in each such first shingle a plurality of (e.g., at least three) vertical overlap indicia are separated from one another by distances that are no more than three inches, e.g., no more than two inches.

Embodiment 44

A roofing system according to any of embodiments 38-42, wherein in each such first shingle a plurality of (e.g., at least three) vertical overlap indicia are separated from one another by distances that are no more than one inch, e.g., no more than one-half inch.

Embodiment 45

A roofing system according to any of embodiments 38-42, wherein in each such first shingle at least five (e.g., at least seven) vertical overlap indicia are separated from one another by distances that are no more than three inches, e.g., no more than two inches.

Embodiment 46

A roofing system according to any of embodiments 38-42, wherein in each such first shingle at least five (e.g., at least seven) vertical overlap indicia are separated from one another by distances that are no more than one inch, e.g., no more than one-half inch.

Embodiment 47

A roofing system according to any of embodiments 38-46, wherein in each such first shingle the vertical overlap indicia are disposed proximate the top edge thereof (e.g., with the nearest one within 4 inches, within 3 inches, within 2 inches or even within one inch of the lateral edge).

Embodiment 48

A roofing system according to any of embodiments 38-47, wherein in each such first shingle the vertical overlap indicia are disposed at a lateral edge of the first shingle Embodiment 49

A roofing system according to any of embodiments 38-48, wherein two sets of vertical overlap indicia are present, a first set disposed proximate the first lateral edge thereof (e.g., with the nearest one within 4 inches, within 3 inches, within 2 inches or even within one inch of the first lateral edge) and a second set disposed proximate the second lateral edge thereof (e.g., with the nearest one within 4 inches, within 3 inches, within 2 inches or even within one inch of the second lateral edge).

Embodiment 50

A roofing system according to any of embodiments 38-49, wherein each such first shingle further includes a vertical registration marker Embodiment 51

A roofing system according to any of embodiments 38-50, wherein for a plurality of the first shingles including vertical overlap indicia (e.g., each such first shingle that is overlapped by another shingle) the first shingle is arranged such that one of the vertical overlap indicia is indexed to a top edge of a shingle of an underlapping course.

Embodiment 52

A roofing system according to any of embodiments 38-50, wherein for a plurality of the first shingles including vertical overlap indicia (e.g., each such first shingle that is underlapped by another shingle) a shingle of an overlapping course is arranged such that it is indexed (e.g., via a vertical registration marker on the shingle of the overlapping course) to one of the vertical overlap indicia of the first shingle.

Embodiment 53

A roofing system according to any of embodiments 38-52, wherein each of the vertical overlap indicia are in the form of line segments, angular shapes (e.g., triangles, diamonds) with a vertex forming each of the indicia, and arrows.

Embodiment 54

A roofing system according to any of embodiments 1-53, wherein n is at least three, and the first number (n) of horizontally-extending courses further includes a third course disposed closer to the top edge of the array than and overlapping the second course with a horizontal offset and a vertical offset with respect to the second course.

Embodiment 55

A roofing system according to embodiment 54, wherein n is at least four, and the first number (n) of horizontally-extending courses further includes a fourth course disposed closer to the top edge of the array than and overlapping the third course with a horizontal offset and a vertical offset with respect to the third course.

Embodiment 56

A roofing system according to embodiment 55, wherein n is at least five, and the first number (n) of horizontally-extending courses further includes a fifth course disposed closer to the top edge of the array than and overlapping the fourth course with a horizontal offset and a vertical offset with respect to the fourth course.

Embodiment 57

A roofing system according to embodiment 56, wherein n is at least six, and the first number (n) of horizontally-extending courses further includes a sixth course disposed closer to the top edge of the array than and overlapping the fifth course with a horizontal offset and a vertical offset with respect to the fifth course.

Embodiment 58

A roofing system according to any of embodiments 1-57, wherein n is at least three, and a first vertical offset between one of the courses and its respective underlying course is different between a second vertical offset between another of the courses and its respective underlying course.

Embodiment 59

A roofing system according to embodiment 58, wherein of the total of (n−1) vertical offset values for each of the second through nth courses with respect to its respective underlying course, no more than 95% are the same, e.g., no more than 75%, or no more than 50%.

Embodiment 60

A roofing system according to any of embodiments 1-57, wherein n is at least three, wherein of the total of (n−1) vertical offset values for each of the second through nth courses with respect to its respective underlying course, in excess of 90% are the same, e.g., in excess of 95%, or all of them are the same.

Embodiment 61

A roofing system according to any of embodiments 1-60 wherein n is at least three, and a first horizontal offset between one of the courses and its respective underlying course is different between a second horizontal offset between another of the courses and its respective underlying course.

Embodiment 62

A roofing system according to embodiment 61, wherein of the total of (n−1) horizontal offset values for each of the second through nth courses with respect to its respective underlying course, no more than 95% are the same, e.g., no more than 75%, or no more than 50%.

Embodiment 63

A roofing system according to any of embodiments 1-60, wherein n is at least three, wherein of the total of (n−1) horizontal offset values for each of the second through nth courses with respect to its respective underlying course, in excess of 90% are the same, e.g., in excess of 95%, or all of them.

Embodiment 64

A roofing system according to any of embodiments 1-63, wherein each of the first number (n) of courses includes at least three first shingles, e.g., at least four first shingles, or at least five first shingles or at least six first shingles.

Embodiment 65

A roofing system according to any of embodiments 1-64, wherein each of the first shingles in a course is the same.

Embodiment 66

A roofing system according to any of embodiments 1-65, wherein at least one course includes first shingles that have a different tab configuration than the first shingles of another course.

Embodiment 67

A method for installing a roofing system according to any of embodiments 1-66, the method comprising providing a plurality of first shingles; and overlapping the plurality of first shingles in a first number, n, of horizontally-extending courses, each course comprising a plurality of linearly arranged first shingles, where n is at least two, with a first course being disposed at the bottom edge of the array, a second course disposed closer to the top edge of the array than and overlapping the first course with a horizontal offset and a vertical offset with respect to the first course, with the sequence continuing, as necessary, to provide a total of n courses, with an nth course disposed closer to the top edge of the array than and overlapping an (n−1)th course with a horizontal offset and a vertical offset with respect to the nth course;

each first shingle comprising a top headlap portion extending from the first lateral edge to the second lateral edge and a bottom tab portion formed of a plurality of tabs extending from the headlap portion toward the bottom edge of the first shingle, the bottom tab portion having an open area that is at least 20% of the total area of the bottom tab portion.

Embodiment 68

A first shingle as described in any of embodiments 1-66.

Embodiment 69

A kit comprising a plurality of first shingles as described in any of embodiments 1-66.

Embodiment 70

The kit of embodiment 69, comprising at least 12 such first shingles, e.g., at least 20 such first shingles, packaged together.

Embodiment 71

The kit of embodiment 69 or embodiment 60, wherein the first shingles of the kit are the same as one another.

Embodiment 72

The kit of embodiment 69 or embodiment 60, wherein there are at least two different types of first shingles (e.g., of different tab shape) in the kit.

What is claimed is:

1. A roofing system comprising a first array of overlapping shingles disposed on a roof, the first array having a top edge, a bottom edge, a first lateral edge and a second lateral edge, each shingle having a top edge, a bottom edge, a first lateral edge and a second lateral edge, wherein each shingle comprises a top headlap portion extending from the first lateral edge to the second lateral edge and a bottom tab portion formed of a plurality of tabs extending from the headlap portion toward the bottom edge of the shingle, wherein the top headlap portion includes at least five horizontal overlap indicia that are separated from one another by distances that are no more than one-half inch, and at least five vertical overlap indicia that are separated from one another by distances that are no more than one-half inch, such that the horizontal overlap indicia extend horizontally and the vertical overlap indicia extend vertically, wherein the horizontal overlap indicia and the vertical overlap indicia are arranged such that an overlapping said shingle can overlap an underlapping said shingle with at least 25 different overlap configurations, each overlap configuration having a lateral edge of the overlapping said shingle indexed to one of the horizontal overlap indicia of the underlapping said shingle, and having one of the vertical overlap indicia of the overlapping said shingle indexed to a feature of the underlapping said shingle, and wherein the bottom tab portion has an open area that is at least 20% of the total area of the bottom lab portion, the system comprising a number, n, of horizontally-extending courses, each course comprising a plurality of linearly arranged said shingles, where n is at least two, with a first course being disposed at the bottom edge of the first array, a second course disposed closer to the top edge of the first array than the first course, with the sequence continuing, as necessary, to provide a total of n courses, with an nth course disposed closer to the top edge of the array than an (n−1)th course, wherein said shingles in the nth course overlap corresponding said shingles in the (n−1)th course with a first one of the at least 25 different overlap configurations, the first overlap configuration having a lateral edge of the overlapping said shingle indexed to one of the horizontal overlap indicia of the underlapping said shingle, and having one of the vertical overlap indicia of the overlapping said shingle indexed to a feature of the underlapping said shingle.

2. A roofing system according to claim 1, wherein each of the shingles is a single-layer shingle.

3. A roofing system according to claim 1, wherein in each shingle, the bottom tab portion has an open area that is at least 40% of the total area of the bottom tab portion.

4. A roofing system according to claim 1, wherein in each shingle, the bottom tab portion has an open area that is no more than 70% of the total area of the bottom tab portion.

5. A roofing system according to claim 1, wherein each of a plurality of the shingles has 2-8 triangular tabs forming a sawtooth pattern extending continuously from the first lateral edge to the second lateral edge thereof, such that two such shingles placed next to one another form a continuous sawtooth pattern.

6. A roofing system according to claim 1, wherein each of a plurality of the shingles has 2-8 rounded tabs forming a wave pattern extending continuously from the first lateral edge to the second lateral edge thereof, such that two such shingles placed next to one another form a continuous wave pattern.

7. A roofing system according to claim 1, wherein each of a plurality of the shingles has 3-8 tabs each defined by opposing linear edges extending from the headlap portion and angled toward one another, and a curved segment joining the linear segments, the curved segment forming the bottom end of the tab.

8. A roofing system according to claim 1, wherein each of a plurality of the shingles has 3-8 tabs each in the shape of a trapezoid.

9. A roofing system according to claim 1, wherein in a plurality of the first shingles, the height of the bottom tab portion is at least 50% of the height of the top headlap portion.

10. A roofing system according to claim 1, wherein each of the plurality of shingles includes at least seven horizontal overlap indicia that are separated from one another by distances that are no more than one-half inch.

11. A roofing system according to claim 1, wherein each of the plurality of shingles includes seven horizontal vertical overlap indicia that are separated from one another by distances that are no more than one-half inch.

12. A roofing system according to claim 1, wherein in each of the plurality of shingles, two sets of horizontal overlap indicia are present, including a first set disposed proximate the first lateral edge thereof and a second set disposed proximate the second lateral edge thereof.

13. A roofing system according to claim 1, wherein n is at least six, and the number (n) of horizontally-extending courses further includes a third course disposed closer to the top edge of the array than the second course and overlapping the second course with a horizontal offset and a vertical offset with respect to the second course;

a fourth course disposed closer to the top edge of the array than the third course and overlapping the third course with a horizontal offset and a vertical offset with respect to the third course;

a fifth course disposed closer to the top edge of the array than the fourth course and overlapping the fourth course with a horizontal offset and a vertical offset with respect to the fourth course; and a sixth course disposed closer to the top edge of the array than the fifth course and overlapping the fifth course with a horizontal offset and a vertical offset with respect to the fifth course.

14. A kit for the installation of a roofing system according to claim 1, comprising a plurality of the shingles.

15. A roofing system according to claim 1, wherein in each shingle, the bottom tab portion has an open area that is at least 30% of the total area of the bottom tab portion.

16. A roofing system according to claim 1, wherein each of the plurality of shingles includes at least seven horizontal overlap indicia that are separated from one another by distances that are no more than one-half inch, and at least seven vertical overlap indicia that are separated from one another by distances that are no more than one-half inch.

17. A roofing system according to claim 1, wherein in the first overlap configuration one of the vertical overlap indicia of the overlapping said shingle is indexed to a top edge of the underlapping shingle.

18. A roofing system according to claim 1, wherein in the first overlap configuration one of the vertical overlap indicia of the overlapping said shingle is indexed to one of the vertical overlap indicia of the underlapping said shingle.

* * * * *